United States Patent [19]

Newman

[11] Patent Number: 4,930,435

[45] Date of Patent: Jun. 5, 1990

[54] ANTI-MOTION SICKNESS APPARATUS

[75] Inventor: Neil A. Newman, Omro, Wis.

[73] Assignee: Brunswick Corporation, Skokie, Ill.

[21] Appl. No.: 330,194

[22] Filed: Mar. 29, 1989

[51] Int. Cl.[5] ..... B63B 29/12

[52] U.S. Cl. ..... 114/191; 114/264

[58] Field of Search ..... 114/121, 122, 270, 191, 114/291, 264; 166/355; 280/6.12

[56] References Cited

U.S. PATENT DOCUMENTS 3,861,696 1/1975 Gustafsson ..... 280/6.12

FOREIGN PATENT DOCUMENTS 221787 12/1983 Japan ..... 114/191

151195 8/1985 Japan ..... 114/191

*Primary Examiner*—Joseph F. Peters, Jr.
*Assistant Examiner*—Jesûs D. Sotelo
*Attorney, Agent, or Firm*—Nicholas A. Camasto; Robert C. Curfiss

[57] ABSTRACT

An anti-motion sickness mechanism comprises a platform suspended from a conveyance for movement about all principal axes. Any vertical movement of from 0 to 0.5 Hz has a tendency to cause motion sickness. A supplementary vertical movement of about 2.5 Hz is added to the platform to break up such vertical movement into sub-movements having a reduced tendency to cause motion sickness.

3 Claims, 7 Drawing Sheets

FIG. 1
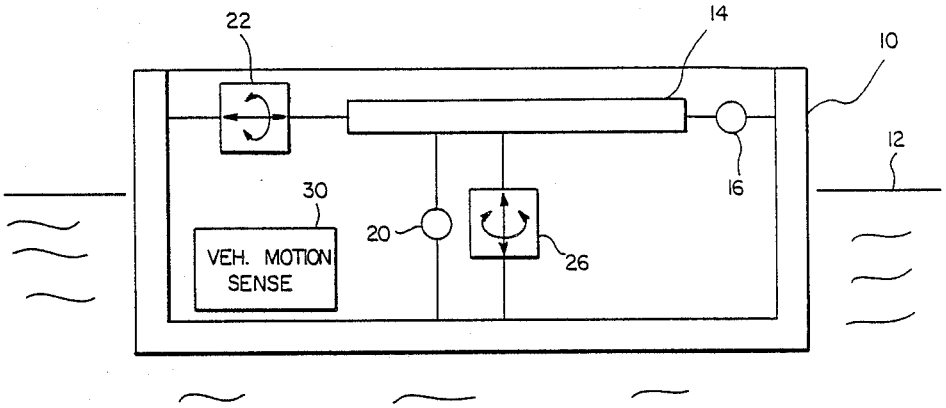
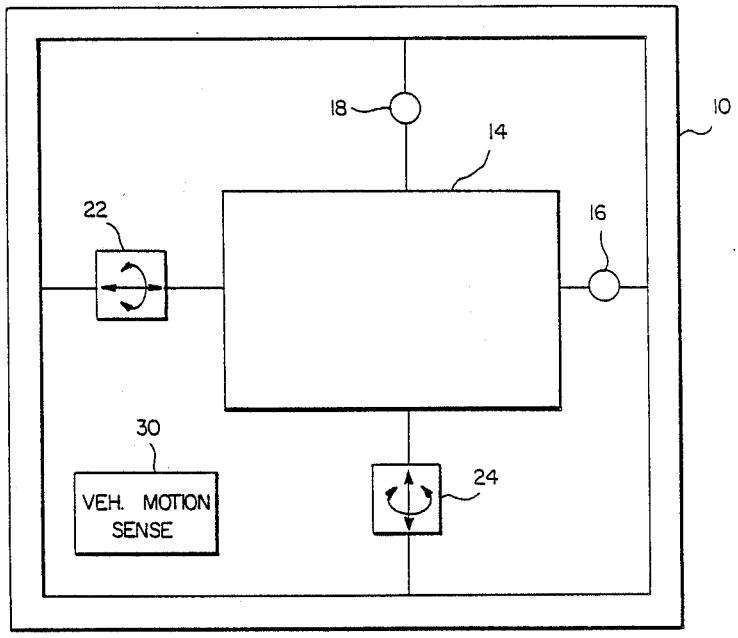
FIG. 2

ANTI-MOTION SICKNESS APPARATUS

BACKGROUND OF THE INVENTION AND PRIOR ART

This invention relates generally to motion sickness and particularly to devices for counteracting motion sickness. Minimizing motion sickness is a long-felt need since it constitutes a significant detriment to all forms of human travel. Numerous studies have been conducted into the nature of motion sickness and its contributing causes and many inventions have been made in an attempt to relieve motion sickness, especially in the environment of ocean-going vessels or craft. Many of the patented devices incorporate a platform that is supported for movement relative to a vessel and which is equipped with devices to offset the vessel motion and thereby keep the platform fairly stable. Obviously, in a sea-going vessel encountering waves on the order of 10 to 20 feet, supporting such a platform so that it is isolated from movement of the vessel is a monumental, if not impossible, feat. For lesser motion amplitudes, on the order of a few feet, the offset required results in a large, unwieldy and expensive apparatus. The prior art devices have all attempted to counteract the rolling, pitching and swaying of a vessel to hold a platform steady and are limited thereby.

While the many studies of motion sickness have not revealed an indisputable single cause, or group of causes, it is clear that certain types of motion have a definite tendency to induce motion sickness. It is not known whether the movements are solely responsible or whether there are unexplained psychological factors involved. It is believed that the perception of certain motions is in itself conducive to motion sickness.

Scientific study has verified that vertical displacement of frequencies up to about 0.5 Hz causes motion sickness in humans. Human perception of other motion may also contribute to or actually cause motion sickness. Motion sickness, while more pronounced in ships and boats, is certainly not confined thereto and air and car sickness are also well known.

With computer technology and sophisticated fluid dynamic control systems, it is well within the realm of realizability to provide a completely controlled vehicle suspension system. In particular, automatically controllable suspension systems for automobiles are known. In such systems, a number of sensors yield information concerning the vehicle angular movements such as "sway," pitch, roll and longitudinal, vertical and lateral linear displacements. A microprocessor computes the necessary forces to be applied to the various suspension points to maintain the vehicle in any predetermined attitude, generally one that corresponds to a level condition. Forces at the suspension points may also be adjusted or overcompensated to, for example, have the automobile "lean in" on a turn rather than lean out in response to the natural forces involved. The speed of response of presently available hydraulic systems is sufficiently great that practically any vibration or motion disturbance can be fully compensated for.

There have been numerous attempts in sea-going vessels to provide captain's chairs and the like that are freely suspended from the vessel to maintain a stable, level position, preferably without significant other motions. It can readily be appreciated, however, that the problem of fully compensating an automotive suspension, encountering motion displacements of a few inches, is relatively simple compared with compensating a platform for a sea-going vessel that encounters waves that are many feet in height. Consequently, there has been no practical or effective anti-seasickness platform developed for use in such vessels. Even in smaller "day-sailers" or pleasure boats, the magnitude of the movements have made such stabilized platforms too large, too cumbersome and much too expensive.

The present invention is a significant departure from the prior art in which the components of motion are attempted to be cancelled or neutralized in order to provide a stable platform and thereby avoid motion sickness. Rather than attempting to offset or compensate such motions, the system of the invention simply adds a relatively small, vertical motion of different frequency that breaks up the sickness inducing motion. For example, a sickness inducing vertical motion of 0.5 Hz may be broken up by imparting a vertical motion of 2.5 Hz frequency to the platform. In a practical setting, the displacement of the platform will have an inverse relationship to the frequency of the displacement and a 2.5 Hz frequency will represent significantly less displacement of the platform. This, of course, translates directly into reduced power for actuating platform movement. The theory of the invention is that breaking up of the fundamental frequency of the vertical movement that induces motion sickness negates the tendency of such movement to induce motion sickness. This theory, in part, explains why it is that people rarely suffer from motion sickness on roller coasters, which certainly involve the particular vertical movement frequencies that have a tendency to induce motion sickness, but also involve many other movements which may effectively mask the motion sickness inducing tendency. The invention also envisions partial compensation for the gross movements of the vessel or conveyance relative to the platform for generally contributing to the comfort and stability of the person or persons supported on the platform.

SUMMARY OF THE INVENTION

A principal object of the invention is to provide a method and apparatus for counteracting motion sickness.

Another object of the invention is to provide a simple method and apparatus for use with a stabilized platform for reducing motion sickness.

A further object of the invention is to provide a novel method of reducing motion sickness.

A still further object of the invention is to provide a method of preventing motion sickness that is adaptable to small craft.

BRIEF DESCRIPTION OF THE DRAWINGS

These and other objects and advantages of the invention will be apparent upon reading the following description in conjunction with the drawings, in which:

FIG. 1 is a simplified block showing of an apparatus constructed in accordance with the invention;

FIG. 2 is a plan view of the apparatus of FIG. 1;

DESCRIPTION OF THE PREFERRED EMBODIMENT

Figure 3:
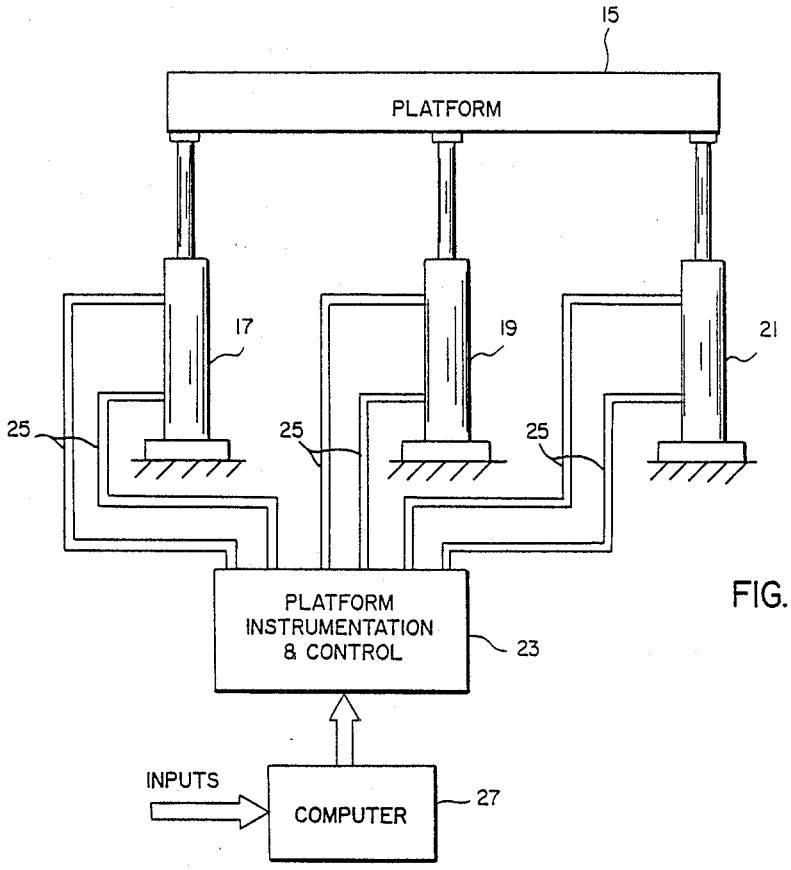
FIG. 3 is a simplified view of a platform constructed and arranged in accordance with the invention.

Referring to FIG. 1, a vessel is generally depicted by reference numeral 10 and is indicated as floating in a body of water or other fluid 12. At the outset, it should be noted that the invention is not restricted to boats, but is perfectly suitable for application to land-based and airborne vehicles. Throughout the specification the description will generally be directed to sea-going vessels, but the invention is not so limited. The term conveyance as used periodically means a vessel, automobile, airplane or any other people transportation device.

A platform 14 is supported from vessel 10 by means of a plurality of actuators, which may be hydraulically controlled shock absorbers such as those used in the prior art for control of platforms on sea-going vessels and for control of suspension systems in automobiles. In FIGS. 1 and 2, a plurality of sensors 16, 18 and 20 determine certain relative motions between platform 14 and vessel 10 and a plurality of actuators 22, 24 and 26 support the platform and impart similar motions to platform 14 relative to vessel 10. Specifically, sensor 16 and actuator 22 are involved with the linear longitudinal and angular rolling motions of platform 14, sensor 18 and actuator 24 are involved with the lateral and pitching motions of platform 14 and sensor 20 and actuator 26 are involved with vertical and yaw motions of platform 14. The forms of the various motions are indicated on the drawings. The actuators may include snubbing type shock absorbers for counteracting the tendency of platform 14 to move with movements in vessel 10. The sensors respond to the relative movement between platform 14 and vessel 10. A vessel motion sense block 30 is indicated and may comprise any of a well known number of means for generally sensing the motions of vessel 10. Vessel motion sense block 30 may include a gyroscope and various sensor mechanisms on a small stable platform for measuring the amount and acceleration of the varying motions experienced by vessel 10.

Figure 4:
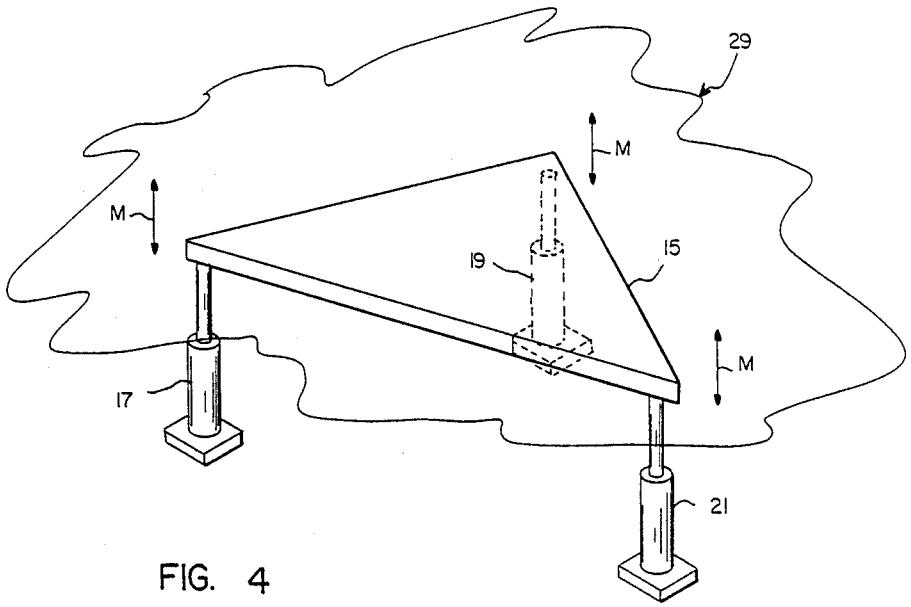
FIG. 4 is a partial perspective view of the platform of FIG. 3.

In FIGS. 3 and 4, a generally triangular shaped platform 15 is supported at each of its three corners by hydraulic lifts or jacks 17, 19 and 21. The jacks are controlled by pressurized oil or the like supplied from a platform instrumentation and control block 23 via conduits 25. Instrumentation and control block 23 is, in turn, controlled by a computer 27 which responds to a number of inputs from the vessel and platform. It will be appreciated that the lifts may also be electrically driven to move the platform vertically and that a larger support area or floor, such as shown at 29, may be supported on the platform. The remaining description will deal with the generalized arrangement of FIGS. 1 and 2, but its applicability to the triangular platform of FIGS. 3 and 4 should be noted.

Figure 5:
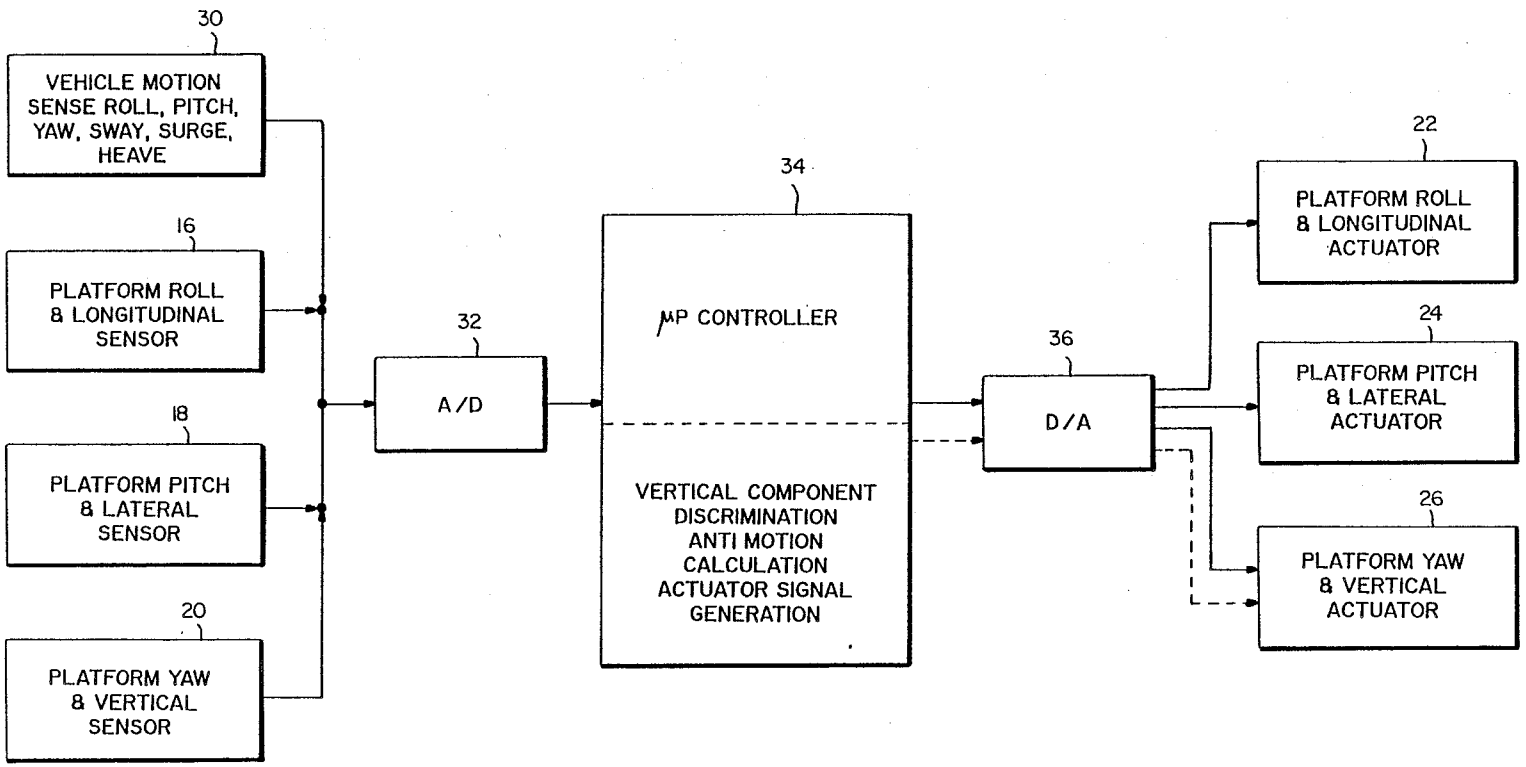
FIG. 5 is a block diagram of the sensors and actuators of the platform control mechanism of the invention.

In FIG. 5, the vessel motion sense block 30 is coupled, along with platform sensors 16, 18 and 20 to an analog-to-digital (A/D) converter 32 which supplies a microprocessor controller 34. The output of the microprocessor controller is coupled to a digital-to-analog (D/A) converter 36 which provides outputs to platform actuators 22, 24 and 26 for controlling positioning of the platform 14 with respect to vessel 10. Microprocessor 34 is indicated as including a vertical component discrimination function, an anti-motion calculation and a vertical actuator signal generation function and, as indicated by the dashed lines, the vertical signals generated are processed through D/A converter 36 and applied to platform yaw and vertical actuator 26. Thus in general, the vessel motion signal components, i.e. its roll, pitch, yaw, sway, surge and heave signals, are sensed and combined with: the platform motion signals, i.e. roll and longitudinal signals, pitch and lateral signals; and yaw and vertical signals. All of these signals are processed by microprocessor controller 34 for developing certain compensating motions for partially stabilizing platform 14. In addition, microprocessor controller 34 determines the vertical component of all of the motions and calculates a vertical antimotion component which is used to develop and apply to the platform yaw and vertical actuator 26 an added vertical motion component to break up any sickness inducing vertical motion of the platform.

Figure 6:
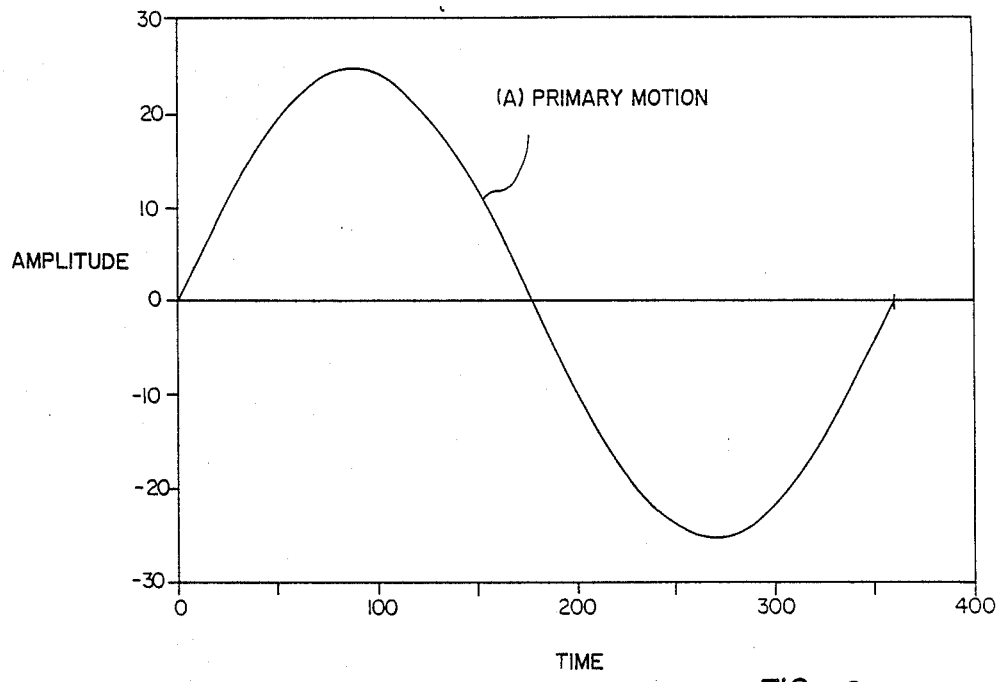
FIG. 6 is a diagram of a primary motion waveform known to induce motion sickness.

In FIG. 6, a sickness inducing motion waveform is indicated by one signal cycle of approximately 0.5 Hz. It will be appreciated that the actual motion waveform would be derived from the composite vertical components of all motion signals developed by the various sensors.

Figure 7:
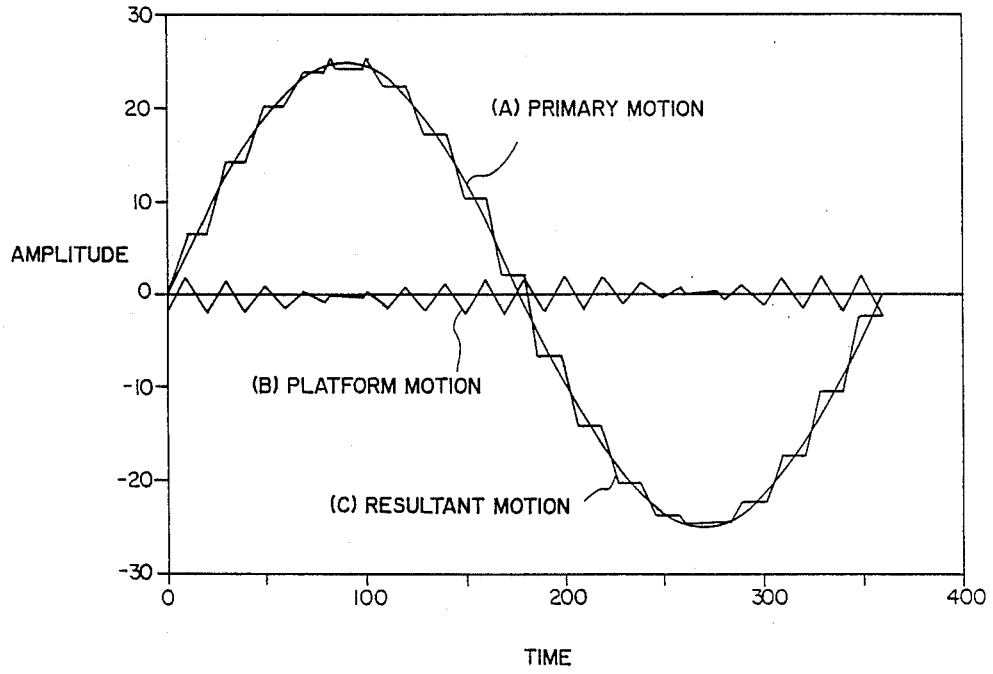
FIG. 7 is a waveform of platform vertical movement with a superimposed higher frequency platform motion and the resultant waveform illustrated.

In FIG. 7, one type of motion that may be added to a primary sickness inducing motion to produce a resultant platform movement which is outside of the motion sickness range, is shown. To the FIG. 5 motion is added a platform motion by which the platform is vertically moved in a non-uniform manner with a waveform of varying amplitude and substantially constant frequency. The frequency is seen to be significantly higher than the frequency of the primary motion. The resultant is seen to be a stepped waveform which breaks up the primary motion into a series of stepped motions to produce a "jiggling" effect. The jiggling effect is believed to be hardly perceptible to a person and to effectively overcome the sickness inducing tendency of the primary motion.

Figure 8:
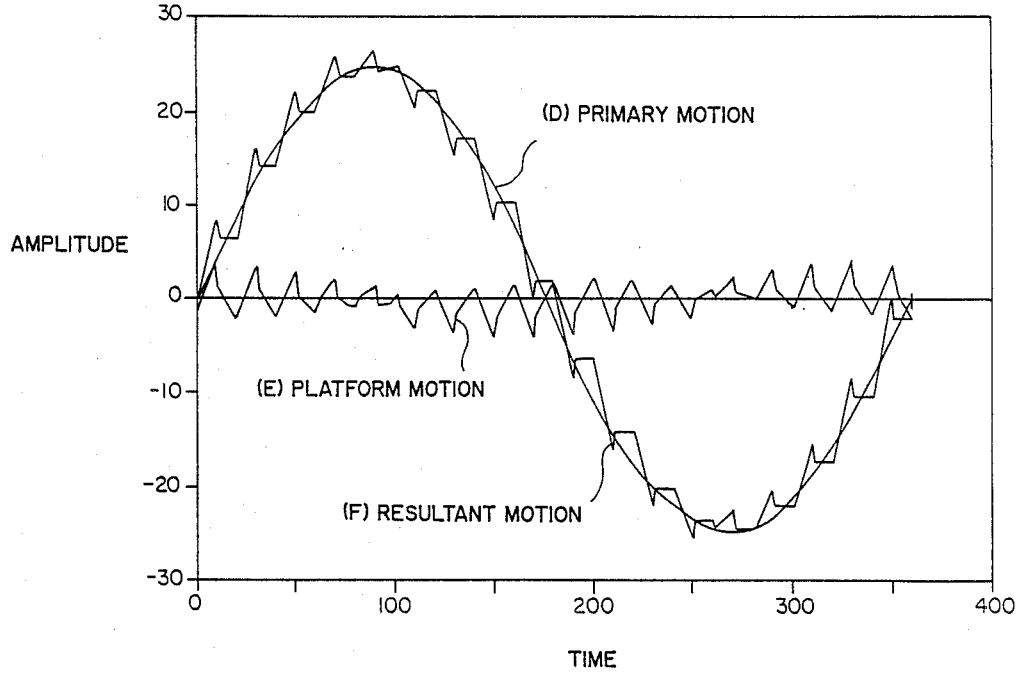
FIG. 8 is similar to FIG. 7 with a different form of added platform motion.
Figure 9:
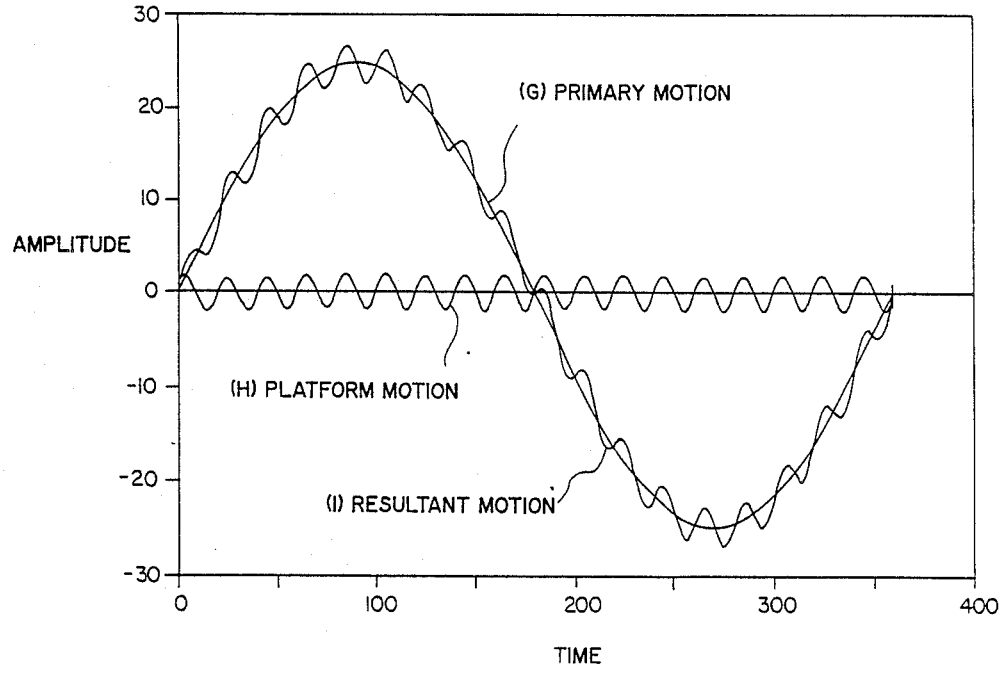
FIG. 9 is a waveform of FIG. 7 with a still different sinusoidal type of added platform motion.

In FIGS. 8 and 9, different forms of platform motion are illustrated with that of FIG. 8 providing for a significant reversal of vertical motion followed by a dwell period. The primary motion is broken up into a series of very choppy motions followed by periods of dwell. In FIG. 9, the added vertical motion is essentially sinusoidal and of a substantially higher frequency than the primary motion.

Figure 10:
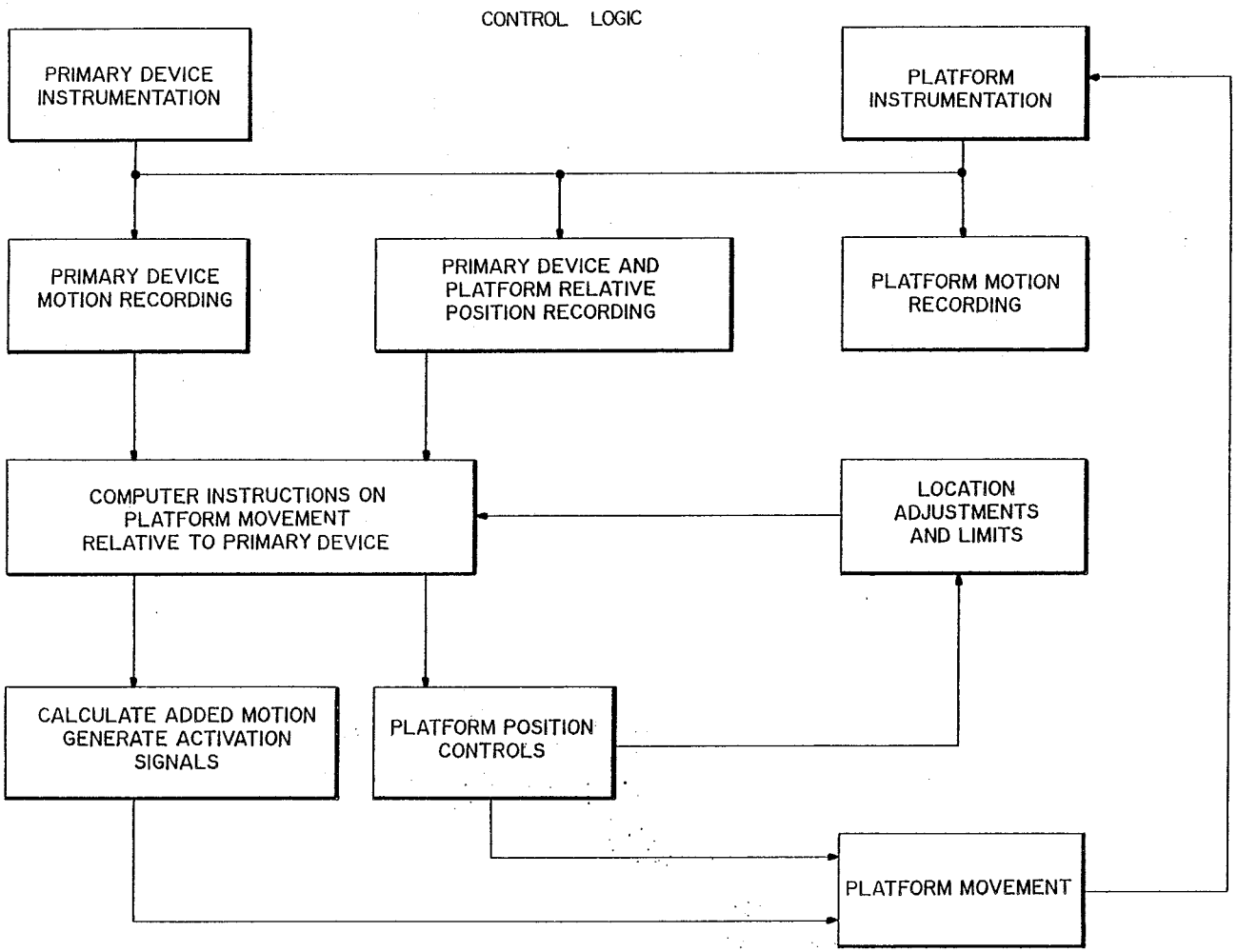
FIG. 10 is a control logic diagram for controlling a platform.

In FIG. 10, the vessel device instrumentation and the platform instrumentation are shown in a block diagram relationship with the blocks indicating the sequence of the activity. The vessel motions and the platform motions are sensed and a relative motion indication is derived. The computer instructions utilizes the vessel motion information and the relative motion information and derives data indicative of the platform actuator positioning. The platform movement itself is controlled by the platform actuator. Another block indicates the derivation of the vertical waveform known to have a tendency to induce motion sickness and the calculation of an anti-motion sickness signal, which is converted to a movement that is added to the platform movement to break up the motion sickness inducing movements of the platform.

Figure 11:
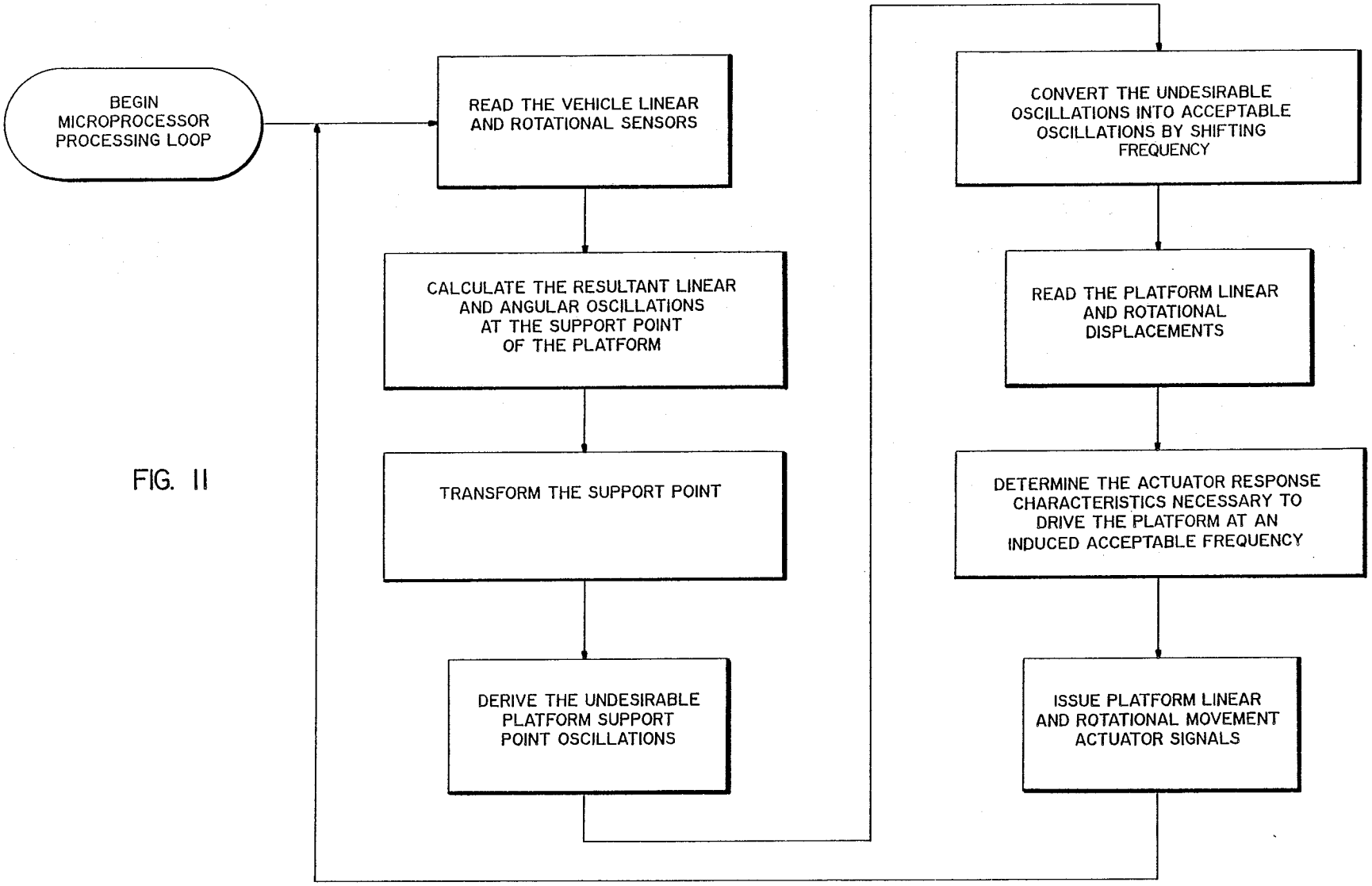
FIG. 11 is a generalized microprocessor processing loop for developing a compensating platform motion in accordance with the invention.

The microprocessor control loop is indicated in FIG. 11. The microprocessor reads the vehicle linear and rotational sensors, calculates the resultant and the linear and angular oscillation at the support points of the platform and transforms these oscillations into gravitationally orientated coordinates. The undesirable platform support point oscillation (vertical movement component under 0.5 Hz) is derived and converted to acceptable oscillations by shifting the perceived frequency as indicated previously. The platform linear rotational displacements are determined and the actuator responses for adjusting the platform to correct the frequency are calculated. The appropriate linear and rotational movement of the platform actuators is then developed to close the processing loop.

It is recognized that there are a myriad of different physical arrangements in which the invention will find application. Certainly, the needs for controlling motion sickness in an aircraft, for example, are substantially less and different from the needs for controlling motion sickness in a land vehicle and still different from those for an ocean-going vessel. It is believed well within the skill of the art to adapt the inventive method and apparatus to these various environments. Accordingly, the invention is to be limited only as defined in the claims.

What is claimed is:

1. Apparatus for use with a conveyance subject to movement;

support means adapted to support at least one person;

suspension means coupling said support means to said conveyance and permitting relative movement therebetween;

sensing means for sensing movement of said support means, said movement including a particular motion tending to cause motion sickness, said particular motion being vertically oriented and having a frequency of less than about 0.5 Hz;

means for modifying said particular motion of said support means;

said modifying means imparting a vertical motion of higher frequency to said support means and breaking up said particular motion into sub-motions of greatly lessened tendency to cause motion sickness.

2. An anti-motion sickness mechanism for a people-carrying conveyance subject to movement;

platform means for supporting one or more people;

suspension means supporting said platform means in said conveyance and permitting relative movement therebetween;

sensing means for sensing vertical displacement of said platform means including a motion sickness causing vertical frequency of less than about 0.5 Hz; and means for imparting additional vertical displacement to said platform means having frequencies higher than said 0.5 Hz and tending to break up said motion sickness causing vertical frequency.

3. A method of precluding motion sickness in a person carried by a moving conveyance comprising the steps of:

supporting said human on a support means capable of movement relative to said moving conveyance;

sensing vertical motions of said support means having frequencies less than about 0.5 Hz including a particular motion having a tendency to induce motion sickness; and imparting a supplementary vertical motion of a frequency of about 2.5 Hz to said support means to modify said particular motion and to reduce said motion sickness tendency.

* * * * *

UNITED STATES PATENT AND TRADEMARK OFFICE

CERTIFICATE OF CORRECTION

PATENT NO. : 4,930,435

DATED : June 5, 1990

INVENTOR(S) : Neil A. Newman

It is certified that error appears in the above-identified patent and that said Letters Patent is hereby corrected as shown below:

The title page showing the illustrative figure should be deleted to appear as per attached title page.

Signed and Sealed this

Twentieth Day of August, 1991

*Attest:*

*Attesting Officer*

HARRY F. MANBECK, JR.

*Commissioner of Patents and Trademarks*

United States Patent [19]

Newman

[11] Patent Number: 4,930,435

[45] Date of Patent: Jun. 5, 1990

[54] ANTI-MOTION SICKNESS APPARATUS

[75] Inventor: Neil A. Newman, Omro, Wis.

[73] Assignee: Brunswick Corporation, Skokie, Ill.

[21] Appl. No.: 330,194

[22] Filed: Mar. 29, 1989

[51] Int. Cl.[5] ..... B63B 29/12

[52] U.S. Cl. ..... 114/191; 114/264

[58] Field of Search ..... 114/121, 122, 270, 191, 114/291, 264; 166/355; 280/6.12

[56] References Cited

U.S. PATENT DOCUMENTS 3,861,696 1/1975 Gustafsson ..... 280/6.12

FOREIGN PATENT DOCUMENTS 221787 12/1983 Japan ..... 114/191

151195 8/1985 Japan ..... 114/191

*Primary Examiner*—Joseph F. Peters, Jr.
*Assistant Examiner*—Jesús D. Sotelo
*Attorney, Agent, or Firm*—Nicholas A. Camasto; Robert C. Curfiss

[57] ABSTRACT

An anti-motion sickness mechanism comprises a platform suspended from a conveyance for movement about all principal axes. Any vertical movement of from 0 to 0.5 Hz has a tendency to cause motion sickness. A supplementary vertical movement of about 2.5 Hz is added to the platform to break up such vertical movement into sub-movements having a reduced tendency to cause motion sickness.

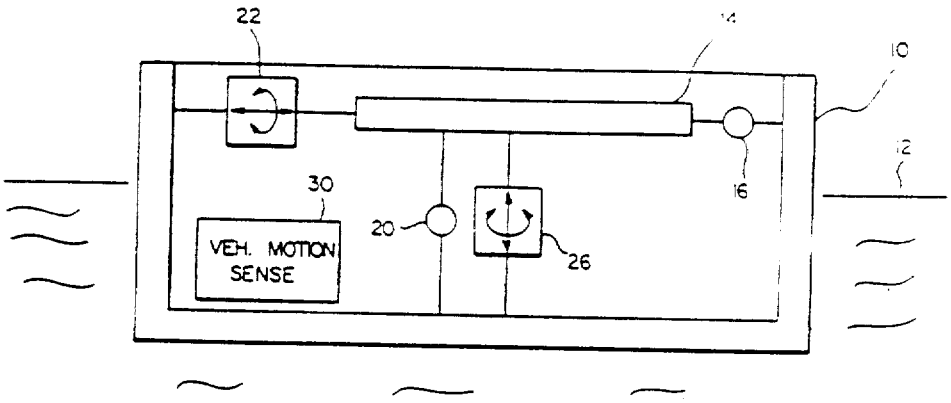

3 Claims, 7 Drawing Sheets